United States Patent [19]

Zimmermann

[11] Patent Number: 4,784,616

[45] Date of Patent: Nov. 15, 1988

[54] POWER SUPPLY DEVICE FOR AN ELECTRICAL APPLIANCE INTENDED FOR PERSONAL USE

[75] Inventor: Walter Zimmermann, Barcelona, Spain

[73] Assignee: Braun Aktiengesellschaft, Kronberg, Fed. Rep. of Germany

[21] Appl. No.: 887,329

[22] Filed: Jul. 22, 1986

[30] Foreign Application Priority Data

Jul. 23, 1985 [ES] Spain ..... 288306

[51] Int. Cl.[4] ..... H01R 33/00

[52] U.S. Cl. ..... 439/568; 248/117.4; 439/343; 439/575; 439/929

[58] Field of Search ..... 439/481, 476, 480, 483, 439/527, 533, 568, 571, 484, 343, 575, 929; 248/117.1–117.7, 231.8, 231.4

[56] References Cited

U.S. PATENT DOCUMENTS 1,606,829 11/1926 Evans ..... 439/527
2,482,957 9/1949 Willens ..... 248/117.7
2,950,889 8/1960 Farrow ..... 248/117.4
3,843,082 10/1974 Garrett ..... 248/231.8
4,403,824 9/1983 Scott ..... 439/680

FOREIGN PATENT DOCUMENTS 8012410 8/1980 Fed. Rep. of Germany .

OTHER PUBLICATIONS

Brochure W 1730-15-2251 of Philips GmbH of Hamburg (particularly pp. 11 and 25).

*Primary Examiner*—Neil Abrams

[57] ABSTRACT

For heating, a cordless iron (2) can be placed on a heating understructure (40) adapted to be connected to an electrical power supply system via a power supply cord (8). For this purpose, the power supply cord (8) has at its one end a power plug (14) adapted to be connected to the power supply system and at its other end a socket connector (18) adapted to be connected to the heating understructure (40). If the iron is to be heated constantly, the socket connector (18) can be disconnected from the heating understructure (40) for connection to the iron (2) direct.

13 Claims, 3 Drawing Sheets

POWER SUPPLY DEVICE FOR AN ELECTRICAL APPLIANCE INTENDED FOR PERSONAL USE

This invention relates to a power supply device for an electrical appliance intended for personal use, in particular an iron, including a plug connector adapted to be connected to a socket connector which is provided on a holding device for the electrical appliance and is connected to a plug connector which is provided on the holding device and is adapted to be selectively connected to a socket connector provided on an electric power supply cord, which socket connector is also connectible to the plug connector of the electrical appliance direct.

A holding device for an electrically driven small appliance or dry shaving apparatus is already known (German utility model DE-GM No. 80 12 410) in which the motor is supplied either from the power mains via a cable adapted to be fitted to an appliance plug or alternatively from chargeable secondary cells direct. For this purpose, the holding device has a plug-and-socket connector including a socket mated to the appliance plug on the one hand and a plug mated to the socket of the power supply cord on the other hand. In the home use of the shaving apparatus, it is thus possible to place the shaver in the holding device or to take it out of the holding device readily without the constant need to plug or unplug the power cord supplying electrical energy to the motor of the shaving apparatus. If, for example, the shaving apparatus is to be taken along on a trip, the power supply cord can be detached from the holding device and the power plug can be unplugged from the outlet readily in order to subsequently connect the socket connector of the power supply cord to the shaving apparatus direct.

In addition, a cordless steam iron is known (Brochure W 1730-15-2251 of Philips GmbH of Hamburg) which for the heating operation can be placed on a heating understructure provided with a socket connector so that the plug of the iron can be inserted into the coupling of the heating understructure as the iron is set down on the heating understructure. To facilitate the placement of the iron on the heating understructure, the latter is provided with a slideway along which the iron slides until its plug is inserted into the socket connector of the heating understructure. At the lower end of the slideway of the heating understructure, discharge openings are provided to allow drainage of the water outflow from the iron.

By contrast, it is an object of the present invention to configure and arrange the electrical appliance as well as its holding device in such a manner that damage to the power supply cord is avoided both as the holding device is set down and as the iron is set down.

By means of the advantageous guide of the power supply cord on the iron and on the holding device, the iron as well as the holding device can be set down readily also with the power supply cord connected, without having to fear damage to the power supply cord. To this end, the socket connector as well as part of the power supply cord connected with the socket connector advantageously do not protrude from the surface of the iron and the holding device when connected. To accomplish this, the iron and the holding device are provided with respective recesses for receiving the socket connector and part of the cord. Advantageously, at least one recess for accommodating the cord or the socket connector extends approximately parallel to the outer surface of the appliance or the holding device.

In order to house the socket connector and the power supply cord connected therewith in the smallest possible space in the appliance or iron or in its holding device, the power supply cord is bent about 180° by means of a cable duct. In the area where the cable duct is connected with the socket connector, a space is formed between the socket connector and the cable duct to receive a guide member for the purpose of facilitating the insertion of the coupling member. The guide member provided in the appliance and in the holding device serves the added purpose of covering the plug pins provided in the appliance and in the holding device.

The recess accommodating the power supply cord may have contractions preventing the power supply cord from accidentally slipping out of the recess after having been inserted therein. Advantageously, the socket connector of the power supply cord may be of rectangular cross section which affords a perfectly snug fit for the socket connector following its insertion into the plug connector.

In another advantageous embodiment of the invention, the holding device has an adjustable clamping assembly by means of which the holding device may be clamped to an ironing board. Since the clamping assembly is formed of two legs extending at right angles to each other and having a bulge in the area of the bend, the bulging part may be closed on the ironing board until the appropriate wire rod of an iron stand arranged on the ironing board locks into the bulge.

The invention will now be described in more detail with reference to the accompanying drawings wherein only one embodiment is shown.

Figure 1:
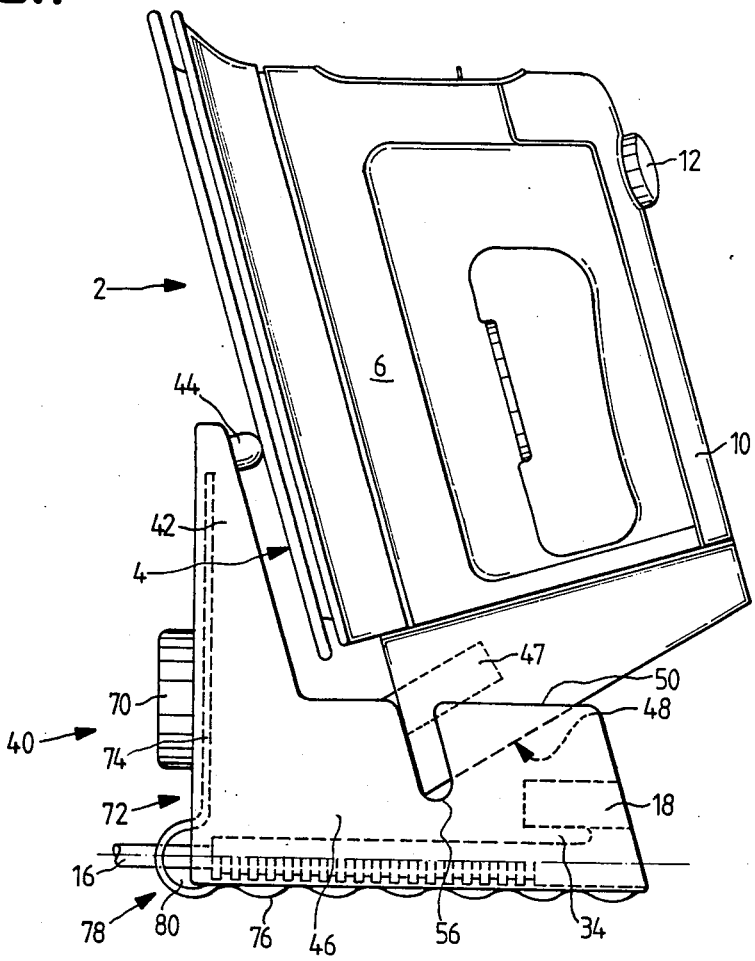
FIG. 1 is a side elevational view of an iron resting on a holding device for the purpose of being heated.

In the drawing, reference numeral 2 generally designates an electrical appliance or an iron which may also be configured as a steam iron. The iron includes a heating plate 4 having a housing 6 to accommodate a heating element not shown in the drawing which is adapted to be connected to a source of electrical energy via a power supply cord 8. A hand grip 10 incorporating a control knob 12 is attached to the housing 6 of the iron 2.

The power supply cord 8 comprises a power plug 14, a socket connector 18 and an electric cable 16 connecting the two end members. In the area of the socket connector, a short portion of the electric cable 16 is carried in a duct 20 keeping the cable free of kinks at the socket connector when the latter is connected.

Figure 5:
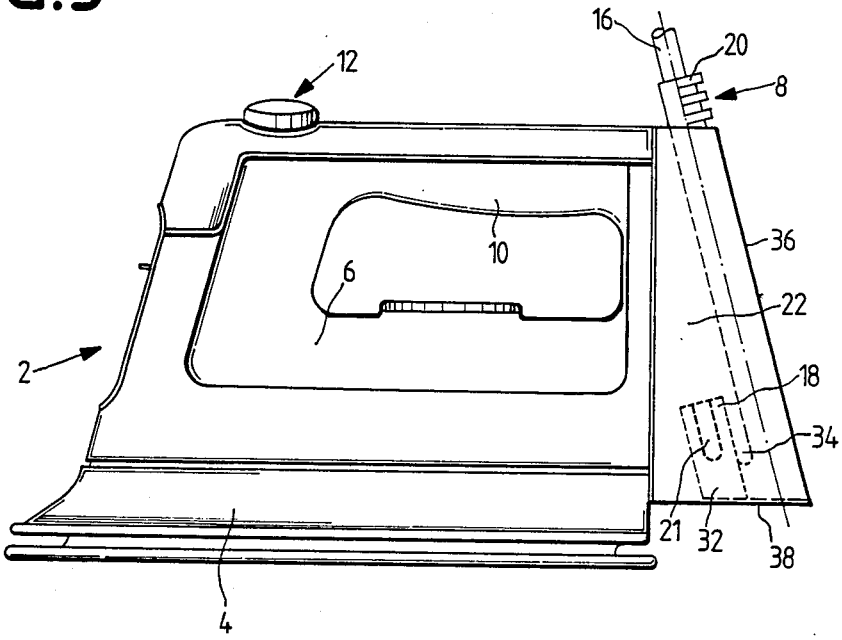
FIG. 5 is a side elevational view of the iron showing the power supply cord connected thereto.
Figure 6:
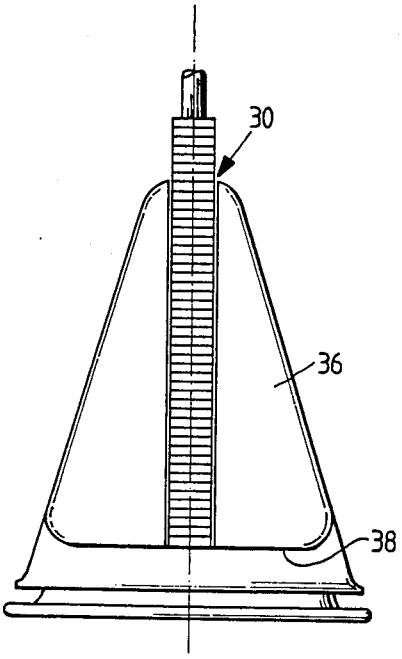
FIG. 6 is a back elevational view of the iron showing the power supply cord connected thereto.

As becomes apparent from FIG. 5, the power supply cord 8 is connected to the iron 2. For this purpose, the iron 2 includes plug connectors 21 having their rearward ends received in a housing member 22 which may be detachably connected with the housing 6.

The socket connector 18 of the power supply cord 8 is comprised of a connector housing 24 of rectangular cross section in which three coupling sleeves 26 arranged side by side in a common plane are provided for engagement by the plug connectors 21 of the iron.

Figure 2:
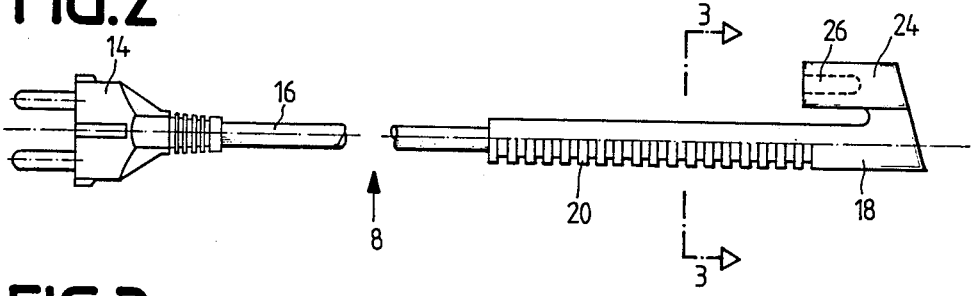
FIG. 2 shows a power supply cord having a power plug and a socket connector for current supply to the iron or to the holding device.
Figure 3:
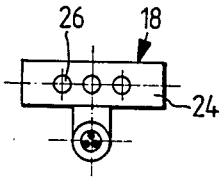
FIG. 3 is a section taken on the line 3—3 of FIG. 2.

As becomes apparent from FIGS. 2 and 3, the connector housing 24 of the socket connector 18 forms an angle of 180° with the cable duct 20 to enable the socket connector 18 and the cable duct 20 connected therewith to be housed in a minimum of space in a recess 30 provided in the housing member 22.

Adjoining the recess 30 accommodating the cable duct 20 is another recess 32 for receiving the plug connectors 21, the two recesses 30, 32 being separated by a guide member 34. The guide member 34 also serves as a cover for the plug connectors 21 provided in the recess 32, in addition to facilitating the insertion of the connector housing 24 into the recess 32 for connection to the plug connectors 21. As seen in FIG. 5, the recess 30 and the recess 32 are configured in such a manner as to completely house the electric cable 16 and the socket connector 18, respectively, without any parts protruding on the rear side or the outer surface 36 and the bottom 38 of the housing member 22. This arrangement permits the iron to be deposited on its rearward end 36 readily without the risk of damage to the electric cable 16 or the socket connector 18. Advantageously, the upper area of the recess 32 includes one or several contractions, not shown in the drawing, which prevent the electric cable 16 or the cable duct 20 introduced into the recess 30 from slipping out of the recess 30.

Figure 4:
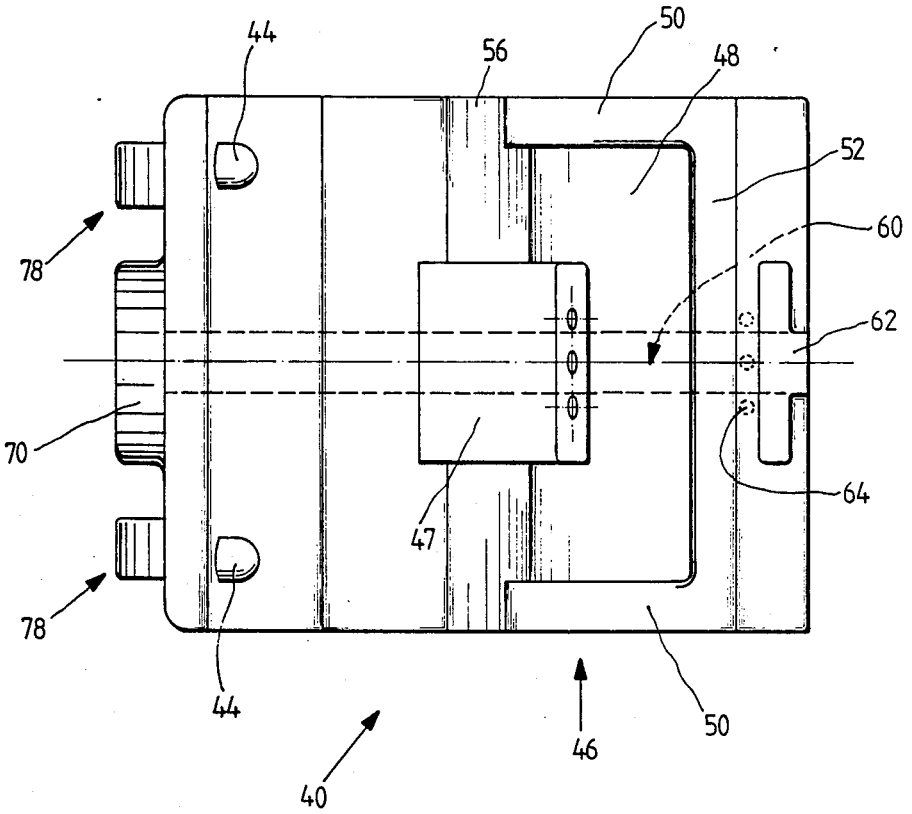
FIG. 4 is a top plan view of the holding device of FIG. 1.

If the electric iron is not to be connected to the power supply cord 8, only the socket connector 18 has to be pulled from the plug connectors 21 of the iron 2, while at the same time disengaging the cable duct 20 from the recess 30. The iron 2 is then ready for use as a cordless iron. If it is necessary to reheat the iron after some time, the iron is placed on a holding device or a heating understructure 40. The heating understructure shown in FIGS. 1 and 4 is composed of an upright wall member 42 having a contact surface or contact knobs 44 against which the heating plate 4 of the iron abuts when deposited on the heating understructure 40. Adjoining at right angles to the upright wall member 42 is a base 46 having in its center a socket connector 47 which serves to connect the plug connectors 21 of the iron 2.

Extending approximately parallel to the outer surface of the socket connector 47 is an inclined seating surface 48 which is bounded by two parallel side walls 50 and a transverse rear wall 52 connecting the two side walls 50. At the lower end of the seating surface 48 is a cross drain 56 which is outwardly open to enable the condensation water collecting in the base 46 to drain off. The lower side of the base 46 has also a recess 60 to receive the cable duct 20 of the power supply cord 8. Adjoining the recess 60 is another recess 62 which is part of a plug connector 64 for receiving the socket connector 18 of the power supply cord 8. If, for example, the power supply cord 8 is connected to the plug connector 64, the cable duct 20 is completely received in the recess 60. Subsequently, only the power plug 14 to be plugged into a suitable outlet of a power supply system. After the base 46 is connected to the power supply system, the iron may be deposited on the setting surface 48 and be approached to the socket connector 47 until the plug connectors 21 of the iron are in engagement with the socket connector 47. By virtue of the advantageous arrangement of the seating surface 48 as well as the two parallel wall members 50, connecting the iron 2 to the base 46 is accomplished very easily. Each time the iron 2 is seated on the heating understructure 40, it is reheated. Following a brief heating period, the iron can then be readily removed from the heating understructure 40 to be used for ironing. However, if the operator wishes the iron 2 to be heated constantly, it is only necessary to pull the socket connector 18 of the power supply cord 8 from the plug connector 64 and to connect it to the plug connector 21 instead.

As becomes apparent from FIG. 1, a clamping assembly 72 formed of a leg 74 secured to the wall member and a leg 76 extending at right angles thereto is fastened to the upright wall member 42 by means of a screw 70, with the leg 76 being of undulating configuration and having a recess or curvature 80 in the area of its bend 78. On loosening the screw 70, the clamping assembly 72 is downwards adjustable, producing a space between the underside of the base 46 and the leg 76 enabling the clamping assembly 72 to be slipped from below onto an iron stand made of wire rods and fitted to the ironing board, until the recess 80 abuts against a suitable rod of the iron stand. The clamping assembly 72 is subsequently upwardly adjusted until it rests firmly against the underside of the wire rods of the iron stand. This provides a simple way of securing the heating understructure 40 to an ironing board.

I claim:

1. An electrical iron system comprising an electrical supply cord having plug type coupling structure for detachable connection to cooperating socket structure, an electric iron intended for personal use, said electrical iron having socket structure for receiving said plug type coupling structure of said power supply cord for supplying electrical power to said electrical iron via said power supply cord when said plug type coupling structure of said power supply cord is inserted into said socket structure of said holder structure, and holder structure adapted to support said iron when not in use, said holder structure including projecting plug type coupling structure similar to said plug type coupling structure of said power supply cord for operatively engaging said socket structure of said iron when said iron is on said holder structure, socket structure similar to said socket structure of said electric iron for detachably receiving said plug type coupling structure of said electric supply cord, said plug type coupling structure of said supply cord, as inserted into either said socket structure of said electric iron or into said socket structure of said holder structure, being flush with the outer surface of either said electric iron or said holder structure in the area of said socket structure, and fixed electrical conductor structure within said holder structure electrically connecting said holder projecting plug type coupling structure and said holder socket structure so that electrical power may be supplied to said electrical iron via said power supply cord, said holder socket structure, said electrical conductor structure and said projecting plug type coupling structure when said iron is on said holder structure and when said plug type coupling structure of said power supply cord is inserted into said socket structure of said holder structure.

2. A system as claimed in claim 1 wherein said power supply cord plug type coupling structure is of rectangular cross section, and includes a wider side surface that defines a recess against which a guide member of said electric iron or said holder structure, respectively, rests, when said power supply cord plug type coupling structure is inserted into the corresponding coupling structure.

3. A device as claimed in claim 1 wherein said holder structure includes a clamping assembly adjustably secured thereto, said clamping assembly including an angular leg which extends approximately parallel to the base of said holder structure.

4. A system as claimed in claim 3 wherein said leg is of undulating configuration.

5. A system as claimed in claim 3 wherein said clamping assembly is formed of two leg portions disposed at approximately right angles to one another, and includes a recess in the area of the junction of said two leg portions.

6. An electrical iron system comprising an electrical supply cord having plug type coupling structure of detachable connection to cooperating socket structure, an electric iron intended for personal use, said electrical iron having socket structure for receiving said plug type coupling structure of said power supply cord for supplying electrical power to said electrical iron via said power supply cord when said plug type coupling structure of said power supply cord is inserted into said socket structure of said holder structure, and holder structure adapted to support said iron when not in use, said holder structure including projecting plug type coupling structure similar to said plug type coupling structure of said power supply cord for operatively engaging said socket structure of said iron when said iron is on said holder structure, socket structure similar to said socket structure of said electric iron for detachably receiving said plug type coupling structure of said electric supply cord, said socket structures of said electric iron and said holder structure each including a first recess that receives said plug type coupling structure of said power supply cord and a second adjacent recess that accommodates a power supply cord portion connected to said power supply cord plug type coupling structure, each said second recess extending generally parallel to the outer surface of said electric iron and said holder structure, respectively, fixed electrical conductor structure within said holder structure electrically connecting said holder projecting plug type coupling structure and said holder socket structure so that electrical power may be supplied to said electrical iron via said power supply cord, said holder socket structure, said electrical conductor structure and said projecting plug type coupling structure when said iron is on said holder structure and when said plug type coupling structure of said power supply cord is inserted into said socket structure of said holder structure.

7. A system as claimed in claim 1 wherein said power supply cord portion is connected with said plug type coupling structure of said power supply cord by a cable duct portion that is disposed in 180° relation to said power supply cord plug type coupling structure.

8. A system as claimed in claim 7 wherein said power supply cord plug type coupling structure has a plurality of coupling sleeves that extend approximately parallel to the center axis of said cable duct portion.

9. A system as claimed in claim 7 wherein an outer surface of said power suppy cord plug type coupling structure is spaced from the outer surface of said cable duct portion to form a recess that receives a guide member provided on said electric iron and on said holder structure, respectively.

10. A system as claimed in claim 9 wherein said holder structure includes an inclined seating surface and upwardly open cross drain structure at the lower end of said inclined seating surface.

11. A system as claimed in claim 6 wherein said second recess has at least one restriction for frictionally securing said power supply cord portion in said second recess.

12. An electrical iron system comprising an electrical supply cord having plug type coupling structure for detachable connection to cooperating socket structure, an electrical iron intended for personal use, said electrical iron having socket structure for receiving said plug type coupling structure of said power supply cord for supplying electrical power to said electrical iron via said power supply cord when said plug type coupling structure of said power supply cord is inserted into said socket structure of said holder structure, and holder structure adapted to support said iron when not in use, said holder structure including projecting plug type coupling structure similar to said plug type coupling structure of said power supply cord for operatively engaging said socket structure of said iron when said iron is on said holder structure, socket structure similar to said socket structure of said electric iron for detachably receiving said plug type coupling structure of said electric supply cord, said power supply cord portion being connected with said plug type coupling structure of said power supply cord by a cable duct portion that is disposed in 180° relation to said power supply cord plug type coupling structure, said power supply cord plug type coupling structure being of rectangular cross section, and including a wider side surface that defines a recess against which a guide member of said electric iron or said holder structure, respectively, rests, when said power supply cord plug type coupling structure is inserted into the corresponding socket structure, fixed electrical conductor structure within said holder structure electrically connecting said holder projecting plug type coupling structure and said holder socket structure so that electrical power may be supplied to said electrical iron via said power supply cord, said holder socket structure, said electrical conductor structure and said projecting plug type coupling structure when said iron is on said holder structure and when said plug type coupling structure of said power supply cord is inserted into said socket structure of said holder structure.

13. A system as claimed in claim 12 wherein each of said second recesses of said electric iron and said holder structure receives a portion of said power supply cord so that said received power supply cord portion does not protrude from the outer surface of said electric iron or said holder structure, respectively.

* * * * *